US008393100B1

(12) United States Patent
Hrehoriak

(10) Patent No.: US 8,393,100 B1
(45) Date of Patent: Mar. 12, 2013

(54) HOLIDAY DISPLAY

(76) Inventor: John T. Hrehoriak, Glen Ellyn, IL (US)

( * ) Notice: Subject to any disclaimer, the term of this patent is extended or adjusted under 35 U.S.C. 154(b) by 0 days.

(21) Appl. No.: 13/312,527

(22) Filed: Dec. 6, 2011

(51) Int. Cl.
*G09F 19/00* (2006.01)

(52) U.S. Cl. ..... 40/429; 472/6; 446/229; 446/228

(58) Field of Classification Search ..... 446/103, 446/433, 332, 454–456, 463, 465–467, 490; 40/617

See application file for complete search history.

(56) References Cited

U.S. PATENT DOCUMENTS

| | | | | | |
|---|---|---|---|---|---|
| 1,674,293 | A | * | 6/1928 | Marx | 104/173.1 |
| 2,357,900 | A | * | 9/1944 | Lenhardt | 446/228 |
| 2,941,332 | A | * | 6/1960 | Tracy | 446/451 |
| 3,405,478 | A | * | 10/1968 | Richter | 446/229 |
| 3,600,843 | A | * | 8/1971 | Becker | 446/228 |
| 3,693,290 | A | * | 9/1972 | Breslow et al. | 446/229 |
| 3,694,648 | A | * | 9/1972 | Yates | 362/311.03 |
| 3,864,868 | A | * | 2/1975 | Wolf | 446/229 |
| 3,922,970 | A | * | 12/1975 | Glastra | 104/91 |
| 4,177,991 | A | * | 12/1979 | Meyer et al. | 273/317 |
| 4,244,136 | A | * | 1/1981 | Kublan | 446/228 |
| 4,266,369 | A | * | 5/1981 | Spector | 446/229 |
| 4,673,848 | A | * | 6/1987 | Hagiwara et al. | 318/266 |
| 4,817,937 | A | * | 4/1989 | Ozeki | 472/10 |
| 4,994,724 | A | * | 2/1991 | Hsu | 318/603 |
| 5,956,880 | A | * | 9/1999 | Sugimoto | 43/2 |
| 5,989,098 | A | * | 11/1999 | Reynolds et al. | 446/485 |
| 6,109,186 | A | * | 8/2000 | Smith et al. | 104/295 |
| 6,110,004 | A | * | 8/2000 | McKinley et al. | 446/490 |
| 6,311,425 | B1 | * | 11/2001 | Capps | 43/3 |
| 6,796,871 | B1 | * | 9/2004 | Hsieh | 446/228 |
| 6,908,066 | B2 | * | 6/2005 | Koenig | 246/122 A |
| 7,264,207 | B2 | * | 9/2007 | Young et al. | 246/1 R |
| 7,654,217 | B2 | * | 2/2010 | Sullivan | 116/22 A |
| 2002/0095833 | A1 | | 7/2002 | Rutkoske | |
| 2003/0155470 | A1 | * | 8/2003 | Young et al. | 246/122 A |
| 2006/0073760 | A1 | * | 4/2006 | Tremel et al. | 446/454 |
| 2009/0111356 | A1 | * | 4/2009 | Haass et al. | 446/444 |
| 2010/0099506 | A1 | | 4/2010 | Tenbrunsel | |

* cited by examiner

*Primary Examiner* — James Kramer
*Assistant Examiner* — Shin Kim
(74) *Attorney, Agent, or Firm* — Donald J. Ersler

(57) ABSTRACT

A holiday display preferably includes a drive unit, at least one object mount, a transport line and an idler pulley device. The drive unit preferably includes a drive motor and a system controller. The drive unit is retained above the ground in one location and the idler pulley device is retained above the ground in another location. A drive pulley is mounted to a drive shaft of the drive motor. The system controller controls the rotation of the drive motor. Both ends of the transport line are secured to the object mount to form a transport loop. One end of the transport loop is retained on the drive pulley and the other end is retained on the idler pulley. The system controller also includes a distance input device for setting a travel distance of the object mount between the drive and idle pulleys.

18 Claims, 6 Drawing Sheets

HOLIDAY DISPLAY

BACKGROUND OF THE INVENTION

1. Field of the Invention

The present invention relates generally to holiday displays and more specifically to a holiday display, which includes at least one object shuttled along a line.

2. Discussion of the Prior Art

Patent application no. 2002/0095833 to Rutkoske discloses a flying ghosts movable ornamental display. Patent application no. 2010/0099506 to Tenbrunsel discloses an apparatus for circulating novelty figures.

Accordingly, there is a clearly felt need in the art for a holiday display, which includes at least one object shuttled back and forth along a line.

SUMMARY OF THE INVENTION

The present invention provides a holiday display, which includes at least one moving object shuttled along a line. The holiday display preferably includes a drive unit, at least one object mount, a transport line and an idler pulley device. The drive unit preferably includes a drive motor and a system controller. The drive unit is retained above the ground in one location and the idler pulley device is retained above the ground in another location. A drive pulley is mounted to a drive shaft of the drive motor. The drive pulley is located outside the drive unit. The system controller controls the rotation of the drive shaft. Both ends of the transport line are secured to the object mount to form a transport loop. One end of the transport loop is retained on the drive pulley and the other end is retained on the idler pulley. The system controller also includes a distance input device for setting a travel distance of the object mount between the drive and idle pulleys.

Accordingly, it is an object of the present invention to provide a holiday display, which includes at least one object shuttled back and forth along a line.

These and additional objects, advantages, features and benefits of the present invention will become apparent from the following specification.

DETAILED DESCRIPTION OF THE PREFERRED EMBODIMENTS

Figure 1:
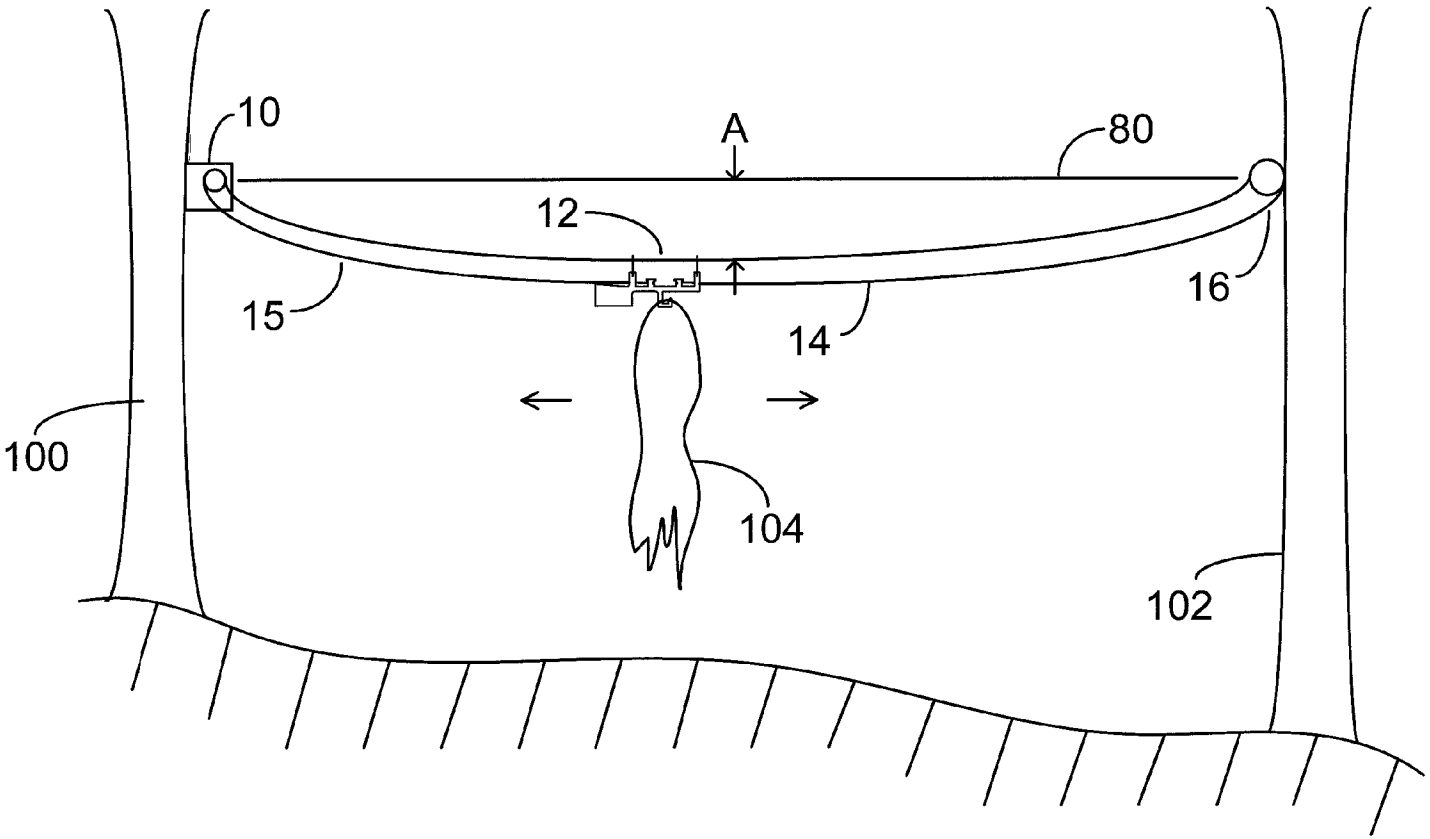
FIG. 1 is a front view of a holiday display with an object suspended therefrom in accordance with the present invention.
Figure 2:
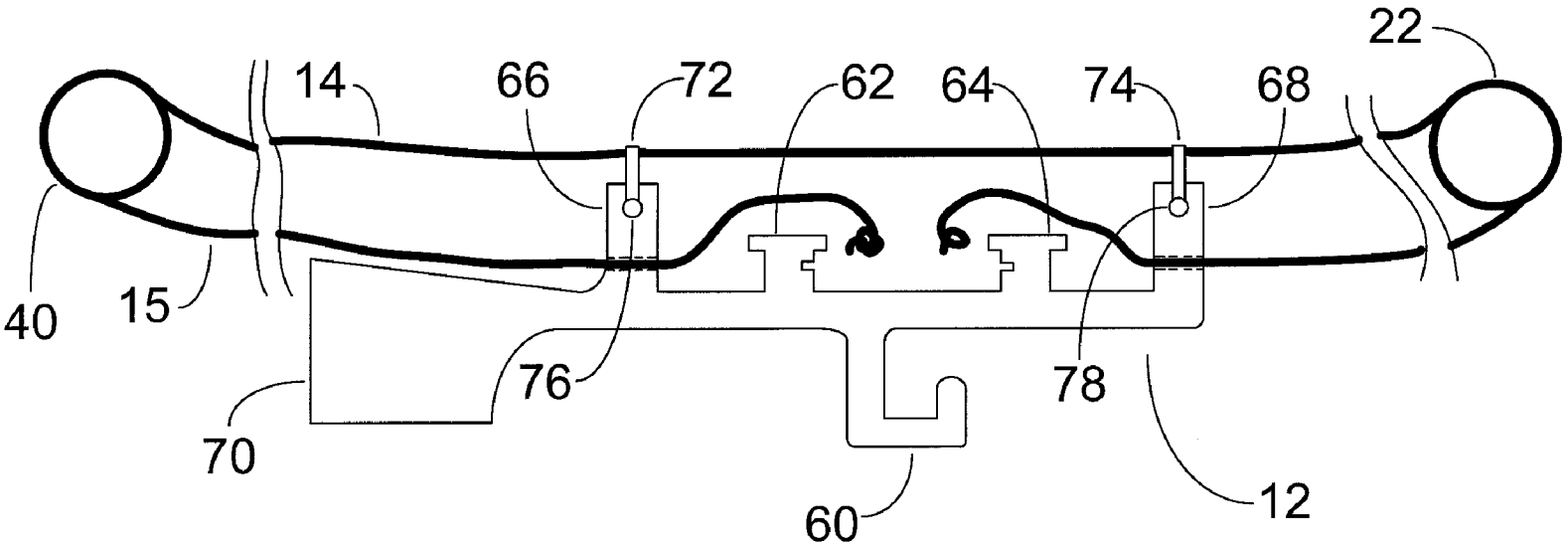
FIG. 2 is a front view of an object mount of a holiday display in accordance with the present invention.
Figure 3:
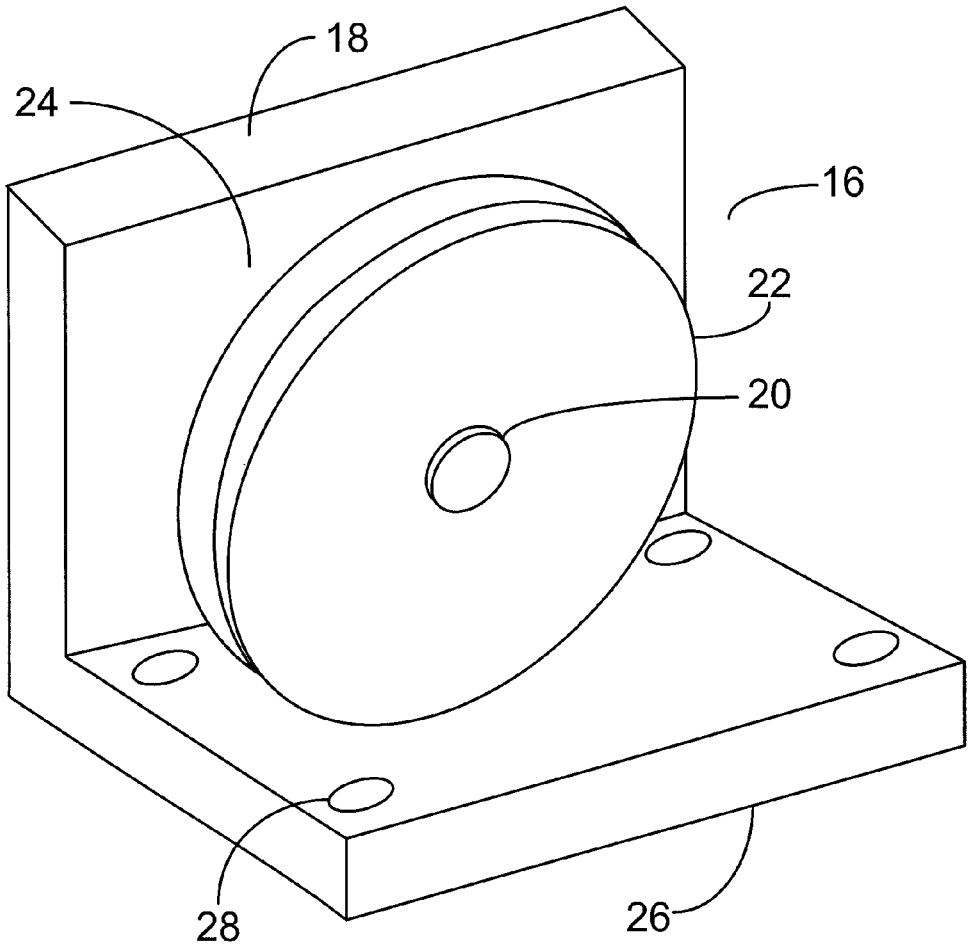
FIG. 3 is a perspective view of an idler pulley device of a holiday display in accordance with the present invention.
Figure 4:
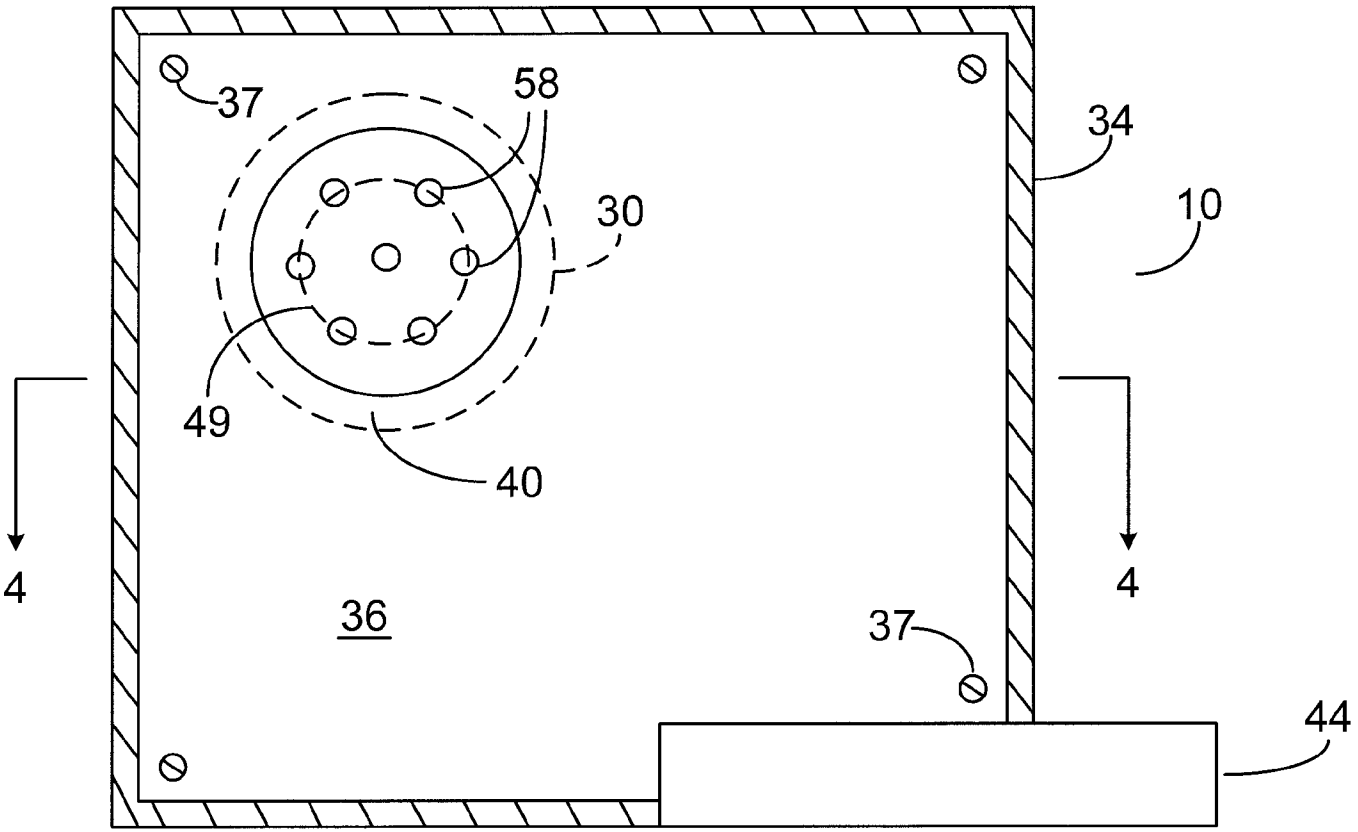
FIG. 4 is a front view of a drive unit of a holiday display in accordance with the present invention.
Figure 5:
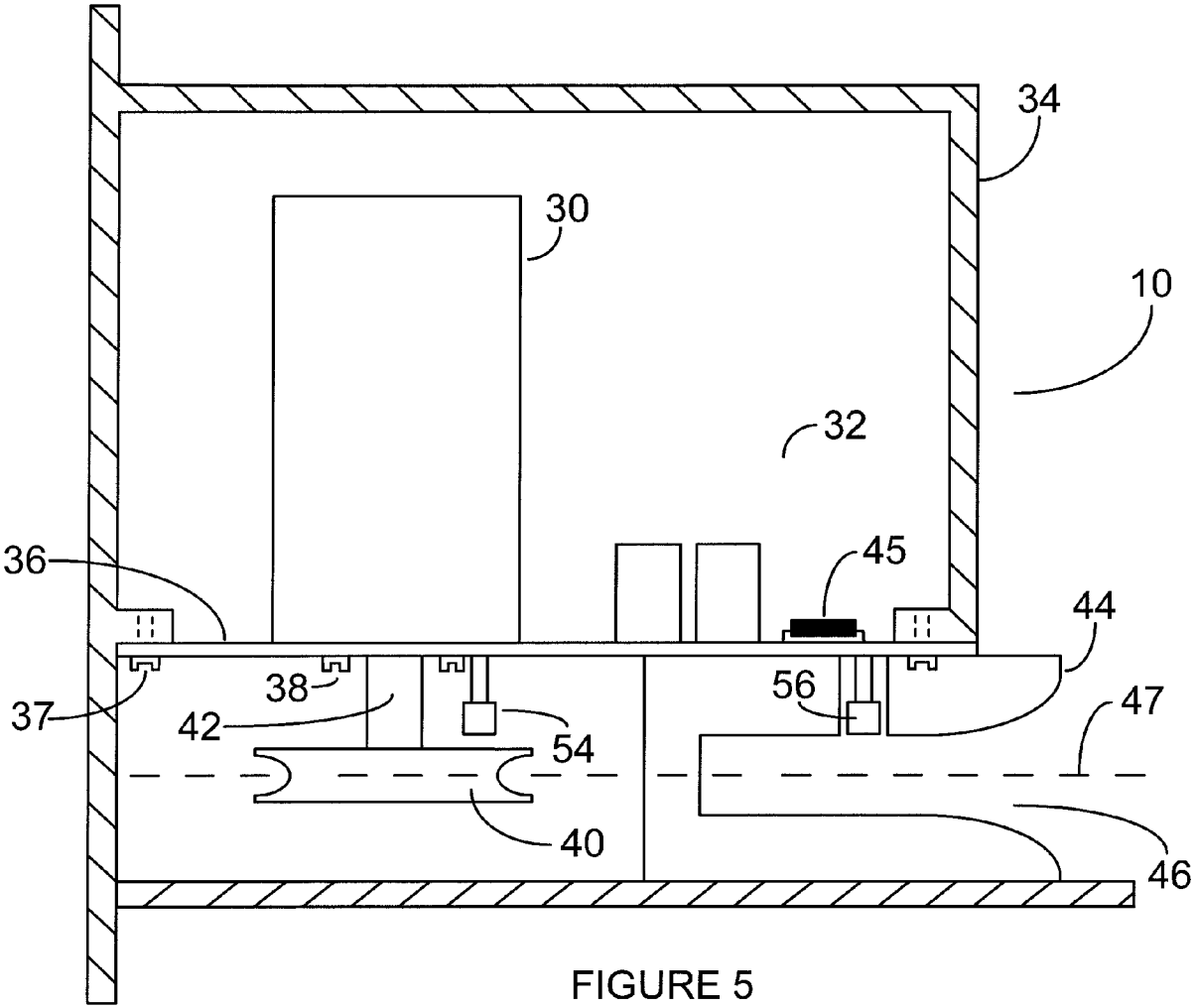
FIG. 5 is a cross sectional view of a drive unit of a holiday display cut through FIG. 4 in accordance with the present invention.

With reference now to the drawings, and particularly to FIG. 1, there is shown a front view of a holiday display 1 supported between a first tree 100 and a second tree 102. With reference to FIGS. 2-5, the holiday display 1 preferably includes a drive unit 10, at least one object mount 12, a transport line 14 and an idler pulley device 16. The idler pulley device 16 includes a mounting bracket 18, a pulley shaft 20 and an idler pulley 22. The mounting bracket 18 preferably includes a pulley plate 24 and a mounting plate 26 extending substantially perpendicular from an end of the pulley plate 24. However, other designs of brackets may also be used. A plurality of mounting holes 28 are formed through the mounting plate 26 for the attachment of the mounting plate 26 to a mounting surface with fasteners. The pulley shaft 20 is secured to the pulley plate 24 with any suitable method, such as press fitting or welding. The idler pulley 22 is rotatable retained on the pulley shaft 20.

The drive unit 10 preferably includes a drive motor 30, a system controller 32 and a housing 34. The drive unit 10 is mounted above the ground in one location and the idler pulley device 16 is mounted above the ground in another location. The system controller 32 includes a circuit board 36. The circuit board 36 is preferably mounted to the housing 34 with fasteners 37. The drive motor 30 is preferably mounted to an inside surface of the circuit board 36 of the housing 34 with fasteners 38. A drive pulley 40 is mounted to a drive shaft 42 of the drive motor 30. The drive pulley 40 is located outside the drive unit 10. An object mount guide 44 is preferably attached to an outside surface of the circuit board 36 with fasteners or the like. The object mount stop 44 includes a guide slot 46, which is sized to receive a thickness of the object mount 12. Both sides of an entrance of the guide slot 46 is curved or chamfered to facilitate the entrance of the object mount 12. A center line 47 of the guide slot 46 is substantially aligned with a centerline of the drive pulley 40.

Figure 6:
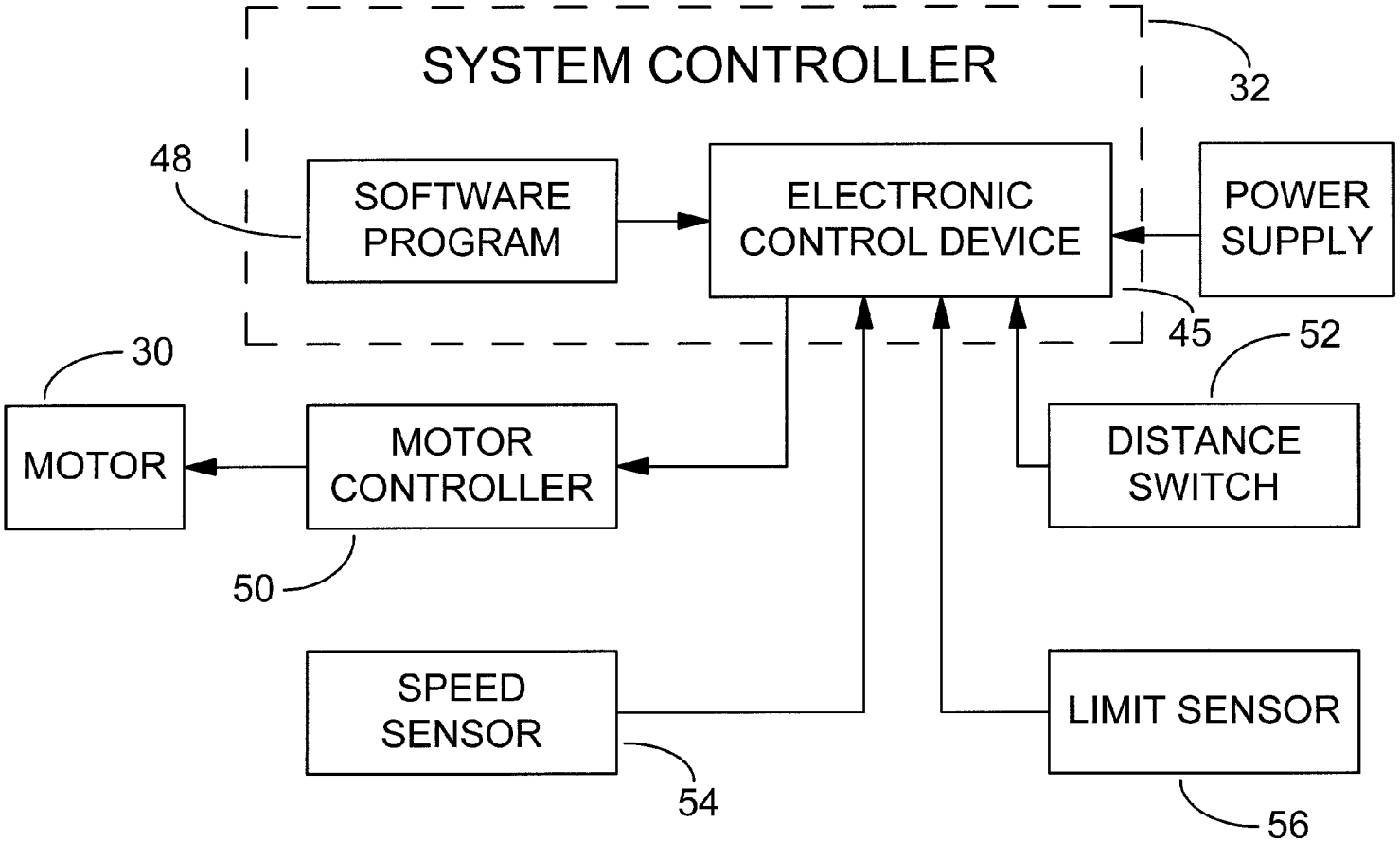
FIG. 6 is a schematic diagram of electrical and electronic components of a holiday display in accordance with the present invention.

With reference to FIG. 6, the system controller 32 includes an electronic control device 45, such as a microcontroller or microprocessor. The electronic control device 45 includes a software program 48. The system controller 32 is connected to a motor controller 50, a distance switch 52, a drive pulley speed sensor 54 and a limit sensor 56. The motor controller 50 controls the speed and direction of the motor shaft 42. The system controller 32 sends instructions to the motor controller 50. A plurality of holes 58 are formed through a front of the drive pulley 40. The plurality of holes are located on a circular centerline 49. The drive pulley speed sensor 54 detects the speed of the drive pulley 40 through the rotation of the plurality of holes 58. The drive pulley speed sensor 54 is preferably mounted to the outside surface of the wall, under the drive pulley 40 and inline with the circular centerline 49.

Each object mount 12 preferably includes an object hanger 60, a first line mount 62, a second line mount 64, a first line support 66, a second line support 68 and an impact end 70. An object 104 is secured to the object hanger 60 with any suitable method. A first tie wrap 72 or the like is inserted through a first hole 76 in the first line support 66 and secured to itself around the transport line 14. A second tie wrap 74 or the like is inserted through a second hole 78 in the second line support 68 and secured to itself around the transport line 14. One end of the transport line 14 is tied or secured to the first line mount 62 and the other end of the transport line 14 is tied or secured to the second line mount 64 to form a transport loop 15. One end of the transport loop 15 is supported on the drive pulley 40 and the other end of the transport loop 15 is supported on the idler pulley 22.

The drive unit 10 is retained on a first surface, above the ground, such as the first tree 100. The idler pulley device 16 is retained on a second surface above the ground, such as the second tree 102. Each end of the transport line 14 is attached to the object mount 12, such that the slack between a horizontal center line 80 of the drive pulley 40 and the idler pulley 22 is no more than dimension "A" from a top of the transport line 14. Dimension "A" preferably has a value of 12 inches. Once the holiday display 1 is installed, the distance for the travel of the object 104 must be set. A pre-determined travel distance is set in the software program. The distance switch 52 is actuated to increase the travel distance of the object 104. Preferably, one toggle of the switch increases the travel distance by 2-3 feet.

The limit sensor 56 is preferably mounted in a side of the guide slot 46. The limit sensor 56 detects if the impact end 70 of the object support 12 is close to the limit sensor 56. Due to numerous conditions, the travel of the object mount 12 may increase. The limit sensor 56 provides feedback to the system controller 32 concerning over travel of the object mount 12. If the limit sensor 56 detects the impact end 70 of the object mount 12, the rotational direction of the drive shaft 42 is reversed. The software program 48 will then establish a new starting position for the object mount 12 relative to the drive unit 10. The system controller 32 causes the drive shaft 42 to alternate between a clockwise rotation and a counter clockwise rotation to cause the object 104 on the transport line to have a substantially linear back and forth movement.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A holiday display comprising:

a drive unit includes a drive motor, a drive pulley and a system controller, said drive pulley is secured to a drive shaft of said drive motor, said system controller controls a speed and rotational direction of said drive pulley, said system controller alternates the rotation of said drive shaft between a clockwise rotation and a counterclockwise rotation, a plurality of holes are formed through a front of said drive pulley, a speed sensor monitors the speed of said plurality of holes in said drive pulley;

an idler pulley device includes an idler pulley;

an object mount includes means for retaining an object; and a transport line having a first end and a second end, said first and second ends of said transport line is secured to said object mount to form a transport loop, said drive pulley is engaged with a first end of the transport loop and said idler pulley is engaged with a second end of the transport loop, wherein said drive unit is retained above the ground, said idler pulley device is retained above the ground, operation of said drive unit causes said object mount to have a substantially linear back and forth movement.

2. The holiday display of claim 1, further comprising:

said system controller includes an electronic control device, said electronic control device includes a software program.

3. The holiday display of claim 1, further comprising:

a motor controller is electrically connected to said drive motor, said system controller is electrically connected to said motor controller.

4. The holiday display of claim 1, further comprising:

an object mount guide extends from a side of said drive unit, a guide slot is formed in said object mount guide to receive an impact end of said object mount.

5. The holiday display of claim 1 wherein:

a limit sensor is retained adjacent said guide slot, said limit sensor detects over travel of said object mount.

6. A holiday display comprising:

a drive unit includes a drive motor, a drive pulley and a system controller, said drive pulley is secured to a drive shaft of said drive motor, said system controller controls a speed and rotational direction of said drive pulley, said system controller alternates the rotation of said drive shaft between a clockwise rotation and a counterclockwise rotation;

an idler pulley device includes a bracket and an idler pulley, said idler pulley is pivotally retained by said bracket;

an object mount includes means for retaining an object;

a distance switch is connected to said system controller, actuation of said distance switch increases travel of said object mount; and a transport line having a first end and a second end, said first and second ends of said transport line is secured to said object mount to form a transport loop, said drive pulley is engaged with a first end of the transport loop and said idler pulley is engaged with a second end of the transport loop, wherein said drive unit is retained above the ground, said idler pulley device is retained above the ground, rotation of said drive unit causes said object mount to have a substantially linear movement.

7. The holiday display of claim 6, further comprising:

said system controller includes an electronic control device, said electronic control device includes a software program.

8. The holiday display of claim 6, further comprising:

a motor controller is electrically connected to said drive motor, said system controller is electrically connected to said motor controller.

9. The holiday display of claim 6, further comprising:

an object mount guide extends from a side of said drive unit, a guide slot is formed in said object mount guide to receive an impact end of said object mount.

10. The holiday display of claim 6 wherein:

a plurality of holes are formed through a front of said drive pulley.

11. The holiday display of claim 10, further comprising:

a speed sensor monitors the speed of said plurality of holes in said drive pulley.

12. The holiday display of claim 6 wherein:

a limit sensor is retained adjacent said guide slot, said limit sensor detects over travel of said object mount.

13. A holiday display comprising:

a drive unit includes a drive motor, a drive pulley and a system controller, said drive pulley is secured to a drive shaft of said drive motor, said system controller controls a speed and rotational direction of said drive pulley, said system controller alternates the rotation of said drive shaft between a clockwise rotation and a counterclockwise rotation;

an idler pulley device includes a bracket and an idler pulley, said idler pulley is pivotally retained by said bracket;

an object mount includes means for retaining an object;

a limit sensor detects over travel of said object mount, said limit sensor sends a signal to said system controller to reverse a rotational direction of said drive shaft; and a transport line having a first end and a second end, said first and second ends of said transport line is secured to said object mount to form a transport loop, said drive pulley is engaged with a first end of the loop and said idler pulley is engaged with the a second end of the transport loop, wherein said drive unit is retained above the ground, said idler pulley device is retained above the ground, rotation of said drive unit causes said object mount to have a substantially linear movement.

14. The holiday display of claim 13, further comprising:

said system controller includes an electronic control device, said electronic control device includes a software program.

15. The holiday display of claim 13, further comprising:

a motor controller is electrically connected to said drive motor, said system controller is electrically connected to said motor controller.

16. The holiday display of claim 13, further comprising:

an object mount guide extends from a side of said drive unit, a guide slot is formed in said object mount guide to receive an impact end of said object mount.

17. The holiday display of claim 13 wherein:

a plurality of holes are formed through a front of said drive pulley.

18. The holiday display of claim 17, further comprising:

a speed sensor monitors the speed of said plurality of holes in said drive pulley.

* * * * *